US005296328A

United States Patent [19]

Fuji et al.

[11] Patent Number: 5,296,328

[45] Date of Patent: Mar. 22, 1994

[54] MAGNETIC BRUSH DEVELOPMENT PROCESS

[75] Inventors: Kazuo Fuji, Higashi-Osaka; Akira Nakakuma, Takaishi; Naruo Yabe, Kobe; Akihiro Watanabe, Kawai; Yoshihisa Kuramae, Hirakata; Toshio Nishio, Nara; Noriaki Tsubota, Himeji; Masahiko Kubo, Yao; Kazuhisa Edahiro, Hirakata, all of Japan

[73] Assignee: Mita Industrial Co., Ltd., Osaka, Japan

[21] Appl. No.: 738,554

[22] Filed: Jul. 31, 1991

[30] Foreign Application Priority Data

Jul. 31, 1990 [JP] Japan ..... 2-203234
Jul. 31, 1990 [JP] Japan ..... 2-203235

[51] Int. Cl.[5] ..... G03G 13/09; G03G 15/09

[52] U.S. Cl. ..... 430/122; 355/251; 118/657

[58] Field of Search ..... 355/251, 253; 118/658, 118/657; 430/122, 125, 126

[56] References Cited

U.S. PATENT DOCUMENTS 4,954,404 9/1990 Inoue et al. ..... 430/45
5,060,023 10/1991 Higashiguchi et al. ..... 355/251
5,070,812 12/1991 Yamaji ..... 118/658
5,202,730 4/1993 Fuji et al. ..... 355/251

OTHER PUBLICATIONS

IBM Technical Disclosure Bulletin, A. H. Knight, "Magnet Configuration For Magnetic Brush Developer", vol. 17, No. 9, Feb. 1975, pp. 2684–2686.

IBM Technical Disclosure Bulletin, "Magnetic Brush Developer Structure", vol. 29, No. 6, Nov. 1986, pp. 2776–2778.

IBM Technical Disclosure Bulletin, W. J. Bernardelli, et al., "Tangental Field Production in Electrophotographic Developers", vol. 26, No. 8, Jan. 1984, pp. 4407–4408.

Xerox Disclosure Journal, "Magnetic Brush Development", D. Dayton, et al., vol. 4, No. 5, Sep. 1979, p. 685.

*Primary Examiner*—Marion E. McCamish
*Assistant Examiner*—Rosemary Ashton
*Attorney, Agent, or Firm*—Sherman and Shalloway

[57] ABSTRACT

The present invention provides a magnetic brush developing method using a two-component developer, characterized in that the development is carried out under such conditions that at the position where the sliding contact of the magnetic brush with the surface of the photosensitive material drum terminates, the following requirement is satisfied:

$$P_x \geqq 430, \text{ or}$$

$$P_x < 430 \text{ and } P_y \geqq -P_x + 800,$$

wherein $P_x$ represents the magnetic force (Gauss) acting in the tangential direction on the surface of the developing sleeve, and $P_y$ represents the magnetic force (Gauss) acting in the normal line direction on the surface of the developing sleeve.

8 Claims, 4 Drawing Sheets

MAGNETIC BRUSH DEVELOPMENT PROCESS

FIELD OF THE INVENTION

The present invention relates to a development process in the electrostatic photography. More particularly, the present invention relates to a magnetic brush development process using a two-component magnetic developer.

DESCRIPTION OF THE RELATED ART

In the field of the electrostatic photography, the magnetic brush development process using a two-component magnetic developer comprising an electroscopic toner and a magnetic carrier is widely carried out.

According to the magnetic brush development process, a two-component magnetic developer is delivered in the form of a magnetic brush by a developing sleeve having magnets disposed in the interior thereof, and the magnetic brush is brought into sliding contact with the surface of a photosensitive material drum. At this point, only the toner charged with a predetermined polarity is delivered onto an electrostatic latent image formed on the surface of the photosensitive material drum and the latent image is visualized to form a toner image. The formed toner image is transferred onto a predetermined paper sheet to form an intended image.

In this development process, a method of increasing the intensity of an electric field formed between the developing sleeve and the photosensitive material drum is generally adopted as the means for increasing the image density, and for this purpose, the voltage applied between the developing sleeve and the photosensitive material drum is increased or the distance between them is shortened.

If the above-mentioned means is adopted, so-called carrier dragging, that is, a problem of transfer and adhesion of carrier particles in the magnetic brush to the surface of the photosensitive material drum, is caused. Furthermore, if in order to obtain an image having a high quality, the magnetic binding force of the magnetic brush is weakened by using a carrier having a low saturation magnetization, carrier dragging becomes more conspicuous.

As the means for preventing occurrence of this carrier dragging, there have been proposed a method in which the magnitude of the magnetic force on the surface of the developing sleeve is increased or the position of the center of the flux of the main magnet arranged in the developing sleeve is inclined from the position of closest proximity to the photosensitive material drum by 2 to 15 degrees toward the upstream side of the developer delivery direction (Japanese Unexamined Patent Publication No. 62-17775), and a method in which the magnetic force applied to the magnetic brush when the magnetic brush comes into the developing zone (the zone where the magnetic brush is brought into sliding contact with the surface of the photosensitive material drum) is made different from the magnetic force applied to the magnetic brush when the magnetic brush comes out from the developing zone.

According to these methods, occurrence of carrier dragging can be controlled to some extent. However, since a strong magnetic force acts in the developing zone, the magnetic brush becomes hard, with the result that the carrier particles in the magnetic brush have bad influences on the latent image area on the surface of the photosensitive material drum and a new problem of reduction of the image quality of the obtained image arises.

SUMMARY OF THE INVENTION

It is therefore a primary object of the present invention to provide a developing process using a two-component magnetic developer, in which carrier dragging is effectively controlled and an image having a high quality can be obtained at a high image density.

More specifically, in accordance with the present invention, there is provided a process for developing an electrostatic latent image, which comprises using a two-component magnetic developer, delivering the magnetic developer in the form of a magnetic brush by a developing sleeve having magnets disposed in the interior thereof, and bringing the magnetic brush of the developer into sliding contact with the surface of a photosensitive material drum to develop an electrostatic latent image formed on the surface of the photosensitive material drum, wherein the development is carried out under such conditions that at the position where the sliding contact of the magnetic brush with the surface of the photosensitive material drum terminates, the following requirement is satisfied:

$$P_x \geqq 430, \text{ or}$$

$$P_x < 430 \text{ and } P_y \geqq -P_+ 800,$$

wherein $P_x$ represents the magnetic force (Gauss acting in the tangential direction on the surface of the developing sleeve, and $P_y$ represents the magnetic force (Gauss) acting in the normal line direction on the surface of the developing sleeve.

According to the developing process of the present invention, even if a developing sleeve having a small diameter is used, the development can be effectively carried out, and therefore, the developing apparatus can be advantageously made compact. Furthermore, even if a carrier having a small saturation magnetization is used, carrier dragging can be effectively prevented, and therefore, an image having a very high quality can be obtained.

DETAILED DESCRIPTION OF THE INVENTION

The present invention is based on the novel finding that if the magnetic force on the developing sleeve surface is separated in vectors in the tangential direction and normal line direction at the point of termination of the sliding contact of the magnetic brush of the two-component developer with the surface of the photosensitive material drum and the magnitude of the magnetic force in each direction is set within a specific range, carrier dragging can be effectively controlled and a defect such as rear end lacking of a solid image area can be effectively overcome.

Figure 1:
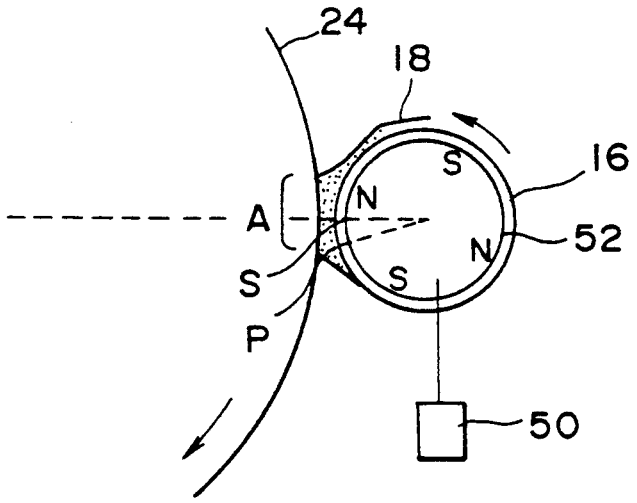
FIG. 1 is a diagram illustrating the state of the developing zone in the process of the present invention.

More specifically, referring to FIG. 1 illustrating the state of the developing zone in the process of the present invention, a developing sleeve 16 is composed of a non-magnetic material such as aluminum, and a magnetic roll 52 is fixed within the sleeve 16. The magnetic roll 52 has a structure in which poles N and poles S are alternately arranged, and by rotating the sleeve 16 in the direction of the arrow, a developer supplied onto the sleeve 16 is delivered in the form of a magnetic brush 18, and the development is effected by the sliding contact of the magnetic brush 18 with a photosensitive material drum 24.

Figure 2:
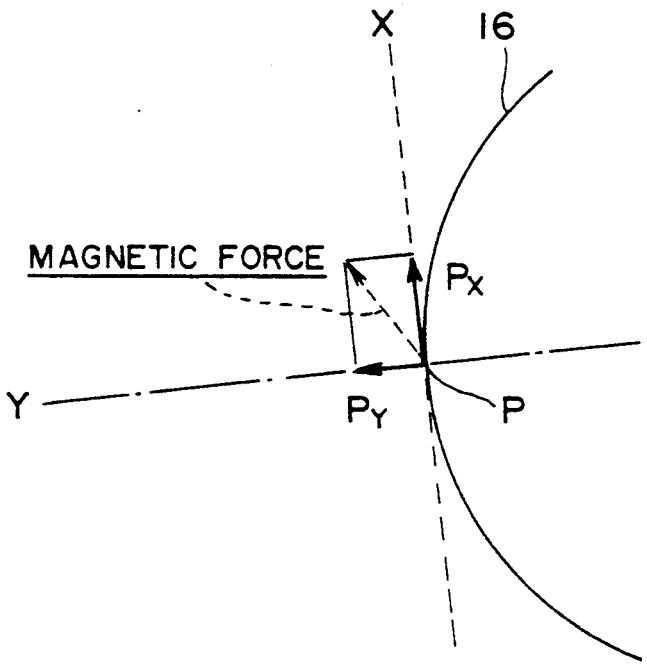
FIG. 2 is a diagram illustrating the magnetic force on the developing sleeve at the position where the sliding contact of the magnetic brush with the photosensitive material drum in the developing zone terminates (at the terminal point of the developing zone).

In the present invention, in a developing zone where the magnetic brush 18 is brought into contact with the photosensitive material drum 24 (represented by A in FIG. 1), the magnetic force acting on the surface P of the sleeve 16 at the position of termination of this sliding contact is separated into vectors of the tangential direction component $P_x$ (Gauss) and the normal line direction component $P_y$ (Gauss), as shown in FIG. 2, and the development is carried out under conditions satisfying the requirement of $P_x \geqq 430$, or $P_x < 430$ and $P_y \geqq -P_x + 800$, whereby carrier dragging can be effectively controlled.

The above conditional formulae were empirically found, and the reason why carrier dragging can be effectively controlled if the above requirement is satisfied has not been sufficiently elucidated, but the present inventors presume as follows.

In the case where $P_x$ is at least 430 Gauss, when the magnetic brush 18 separates from the surface of the photosensitive material drum 24, a large magnetic force acts on the magnetic brush 18 toward the tangential direction of the sleeve 16, and therefore, the magnetic brush 18 is in the state lying on the surface of the sleeve 16. Accordingly, transfer of the carrier to the photosensitive material drum 24 from the magnetic brush, that is, carrier dragging, can be effectively controlled.

Furthermore, if the magnetic force component $P_y$ in the normal line direction is not smaller than $-P_x + 800$ even though $P_x$ is smaller than 430 Gauss, the force of attracting the magnetic brush 18 to the surface of the sleeve 16 is large and therefore, carrier dragging can also be effectively controlled.

In the present invention, by adjusting the magnitude of the tangential direction component of the magnetic force on the surface of the developing sleeve in the above-mentioned manner, carrier dragging can be effectively controlled, and so far as the above requirement is satisfied, a magnetic carrier having a small saturation magnetization can be used, for example, by reducing the intensity of the magnets in the developing sleeve. This means that an image having a high quality can be obtained while preventing carrier dragging.

The adjustment of the magnetic force $P_x$ in the tangential direction and the magnetic force $P_y$ in the normal line direction can be accomplished, for example, by appropriately arranging the positions of poles N and poles S in the magnet roll 52 according to the diameter of the developing sleeve 16. It is preferred that the maximum magnetic force of each of the poles N and S in the magnetic roll 52 be smaller than 1500 Gauss, especially smaller than 1200 Gauss. If the magnetic force exceeds the above-mentioned range, the magnetic brush becomes hard and the quality of the obtained image tends to lower.

In accordance with one preferred embodiment of the present invention, the development is carried out by supplying the developer so that the developer occupancy ratio R in the developing zone, represented by the following formula, satisfies the requirement of $30 < R < 40$:

$$R = M \times (T/D \times 1/\sigma t + C/D \times 1/\sigma c)/H$$

wherein M represents the amount (g/cm$^2$) of the developer delivered per unit area of the developing sleeve, H represents the distance (cm) between the photosensitive material drum and the developing sleeve at the position (S) where both approach each other most closely, T/D represents the toner concentration (% by weight) in the developer, C/D represents the carrier concentration (% by weight) in the developer, $\sigma t$ represents the true density (g/cm$^3$) of the toner, and $\sigma c$ represents the true density (g/cm$^3$) of the carrier.

The developer occupancy ratio R is a dimensionless number which indicates the ratio (%) of the volume occupied by the two-component developer in the volume of the developing zone A. Namely, this value R defines the flowing state of the developer and governs the capacity of supplying the toner in the developer and the force of controlling scattering of the toner. For example, as the value R becomes small, the ratio of the developer occupying the developing zone A is reduced, and therefore, air currents passing through the developing zone A along the rotation direction of the photosensitive material drum 24 and the rotation direction of the developing sleeve 16 are formed. Therefore, the toner is readily scattered along these air currents from the developing zone A. If the value R is further decreased, the image density is reduced not only by scattering of the toner but also by reduction of the toner-supplying capacity. On the other hand, as the value R becomes large, the ratio of the developer occupying the developing zone A increases, and clogging of the developing zone A with the developer is readily caused and smooth flow of the developer is inhibited, with the result that a load is imposed on the developing sleeve 16. Accordingly, the developing sleeve 16 is not allowed to rotate smoothly and the magnetic brush of the developer is disturbed, and scattering of the toner is readily caused. According to the process of the present invention, by carrying out the development under such conditions that the value R is larger than 30% but smaller than 40%, scattering of the toner from the developing zone A is effectively prevented and an image having an appropriate density can be formed.

The adjustment of the value R can be accomplished by adjusting the magnetic force of the magnetic roll 52 in the developing sleeve 16, the cut length of the magnetic brush, the characteristics of the developer, the peripheral speed of the developing sleeve, and the like.

In the developing process of the present invention, as shown in FIG. 1, the developing sleeve 16 is connected to a power source 50, and an alternating voltage forming an alternating electric field between the maximum potential and minimum potential of an electrostatic latent image formed on the surface of the photosensitive material drum 24 is applied, whereby image unevenness, image fogging and scattering of the toner to the non-image area can be effectively prevented. It is considered that a disadvantage such as scattering of the toner is due mainly to the supply of an excessive amount of the toner to the latent image on the surface of the photosensitive material drum 24. However, by applying the above-mentioned alternating voltage, the excessive toner adhering to the latent image area or the vicinity thereof is recovered to the developing sleeve 16, with the result that scattering of the toner can be prevented. An alternating voltage having a peak voltage between the maximum potential and minimum potential of the electrostatic latent image can be used, and the peak voltage is preferably 60 to 90% of the voltage difference between the maximum potential and minimum potential. The alternating voltage is generally 100 to 800 V and preferably 300 to 700 V. For example, it is preferred that in the state where this alternating voltage is applied, the potential of the developing sleeve 16 be a value between the surface potential and remaining potential of the photosensitive material drum. It also is preferred that the frequency of the alternating voltage be 0.2 to 4 kHz, especially 0.5 to 3 kHz.

If this developing process comprising applying an alternating voltage is adopted for formation of dot images, scattering of the toner to the periphery of a dot image can be effectively prevented, and therefore, this developing process can be especially advantageously applied to formation of images by a so-called digital copying machine.

Figure 3:
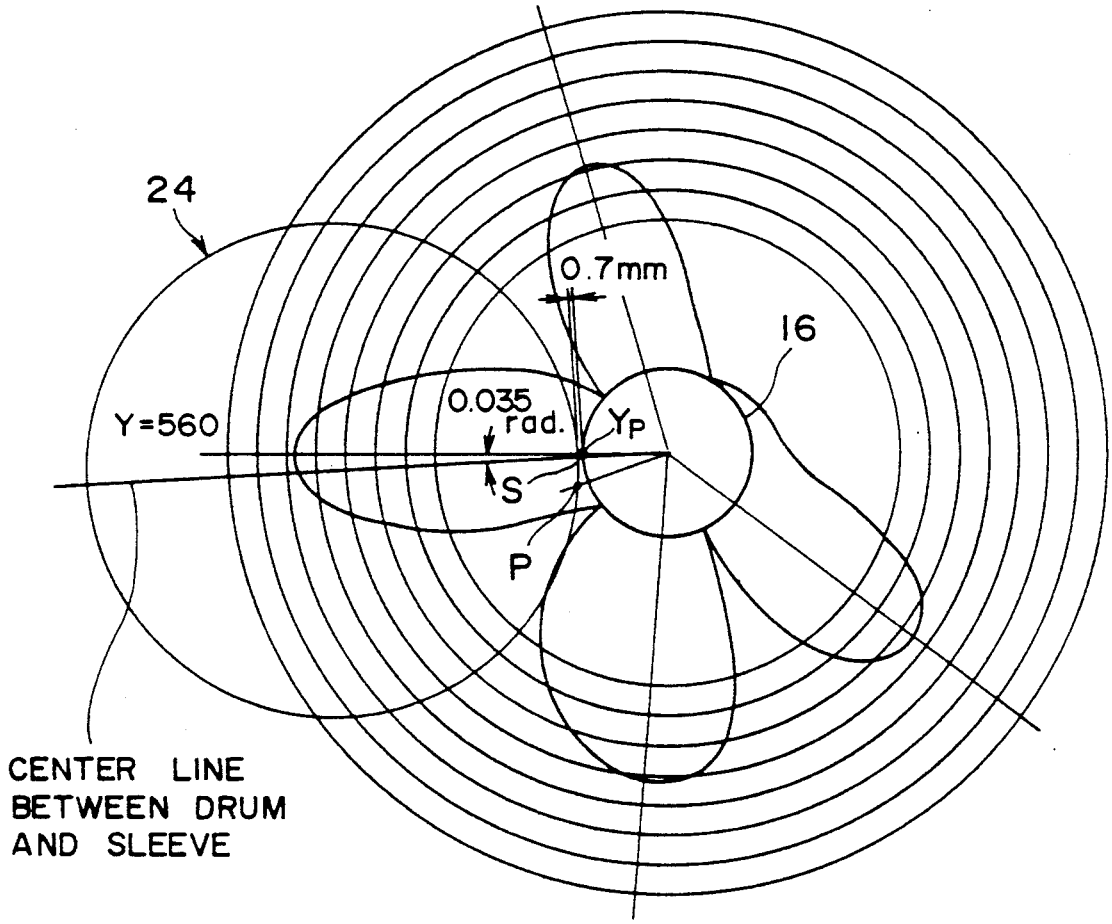
FIG. 3 is a diagram illustrating the distribution of the magnetic force in the normal line direction of the developing sleeve in Run 4–2 of Example 4.

In the present invention, referring to FIG. 3 illustrating the distribution of the magnetic force in the normal line direction on the surface of the developing sleeve in the developing zone A, it is preferred that the position $Y_p$ showing the maximum magnetic force on the surface of the developing sleeve be biased by 0.035 to 0.5 radian, especially 0.14 to 0.42 radian, toward the upstream side of the flow direction of the developer from the position S where the developing sleeve 16 and the photosensitive material drum 24 become closest to each other. Namely, by deviating the position of the maximum magnetic force in the normal line direction from the central position S of the developing zone to a certain extent, the magnetic brush 18 becomes lying to the upstream side of the flow direction of the developer, and therefore, in the developing zone A, the magnetic brush 18 does not impinge strongly to the photosensitive material drum 24, the freedom of the magnetic brush, i.e., the magnetic carrier, increases. Accordingly, formation of a sweeping trace of the carrier on the formed image can be effectively prevented.

In the case where the position $Y_p$ of the maximum magnetic force is adjusted in the above-mentioned manner, an image having a high quality can be obtained even under conditions where the range of the developer occupancy ratio R is expanded to $30<R<75$, and the limitations of the developing conditions can be moderated. Also in this embodiment, scattering of the toner can be effectively prevented by applying an alternating voltage as mentioned above to the developing sleeve 16.

In the present invention, it is preferred that the peripheral speed of the developing sleeve be 60 to 800 mm/sec, especially 90 to 450 mm/sec, and it is preferred that the cut length of the magnetic brush be 0.6 to 1.6 mm, especially 0.8 to 1.4 mm, though the preferred cut length depends on the flux density to some extent.

It also is preferred that the D-S distance (H) be 0.4 to 1.6 mm, especially 0.6 to 1.4 mm. In the present invention, the diameter of the developing sleeve 12 can be 15 to 50 mm, and the occupancy ratio of the developing sleeve 12 in the developing mechanism can be reduced.

In the present invention, as the photosensitive material, there can be used any of photosensitive materials customarily used for the electrophotography, such as a selenium photosensitive material, an amorphous silicon photosensitive material, a zinc oxide photosensitive material, a cadmium selenide photosensitive material, a cadmium sulfide photosensitive material, and various organic photosensitive materials.

The direct current bias voltage to be applied between the developing sleeve and the electroconductive substrate of the photosensitive material drum is preferably such that the average electric field intensity is 100 to 1,000 V/mm, especially 125 to 700 V/mm.

The developer used in the developing process of the present invention will now be described.

A magnetic carrier having a density $\alpha c$ of 3.50 to 6.50 g/cm$^3$, especially 4.00 to 5.50 g/cm$^3$, is preferably used, though the preferred density depends on the carrier concentration C/D to some extent. A ferrite type magnetic carrier is especially preferably used.

As the ferrite, there have been used sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$). Especially, soft ferrites containing at least one member, preferably at least two members, selected from the group consisting of Cu, Zn, Mg, Mn and Ni, for example, a copper/zinc/magnesium ferrite, have been used. In the present invention, of these ferrites, those satisfying the above requirement are used.

It is preferred that the saturation magnetization of the carrier be 40 to 65 emu/g, especially 45 to 56 emu/g. A ferrite carrier, especially a spherical ferrite carrier, satisfying this requirement is preferably used as the magnetic carrier. It is preferred that the particle size of the ferrite carrier be 20 to 140 $\mu$m, especially 50 to 100 $\mu$m.

Of course, the electric resistance of the ferrite carrier varies according to the chemical composition thereof, but the electric resistance also depends on the particulate structure, the preparation process and the kind and thickness of coating. In general, it is preferred that the volume resistivity of the ferrite carrier be $5\times10^8$ to $5\times10^{11}$ $\Omega$-cm, especially $1\times10^9$ to $1\times10^{11}$ $\Omega$-cm.

A toner having a density $\sigma t$ of 1.00 to 1.40 g/cm$^3$, especially 1.10 to 1.20 g/cm$^3$, is used, though the preferred density differs according to the density of the magnetic carrier or the toner concentration.

The toner used in the present invention is formed by incorporating a coloring agent, a charge-controlling agent and optionally, known toner additives into a binder resin medium, and a toner having an electroconductivity of $1\times10^{-11}$ to $5\times10^{-9}$ /cm, especially $5\times10^{-10}$ to $1\times10^{-9}$ /cm, is preferably used, and it is preferred that the dielectric constant of the toner be 2.5 to 4.5, especially 2.5 to 4.2.

The binder resin medium, coloring agent, charge-controlling agent and other toner additives are selected and combined so that the above-mentioned characteristics will be obtained. As the binder resin medium, there can be used a styrene resin, an acrylic resin, a styrene/acrylic resin, a polyester, an epoxy resin, a rosin-modified maleic acid resin, a silicone resin, a xylene resin and a polyvinyl butyral resin. It is preferred that the resin to be used should have an acid value of 0 to 25. In view of the fixing property, it is preferred that the glass transition temperature be 50° to 65° C.

Known inorganic and organic pigments and dyes can be used singly or in the form of mixtures of two or more of them as the coloring agent to be incorporated into the resin. For example, there can be mentioned carbon blacks such as furnace black and channel black, iron blacks such as triiron tetroxide, rutile type titanium dioxide, anatase type titanium dioxide, Phthalocyanine Blue, Phthalocyanine Green, cadmium yellow, molybdenum orange, Pyrazolone Red and Fast Violet B.

Known charge-controlling agents can be used. For example, there can be mentioned oil-soluble dyes such as Nogrosine Base (CI 50415), Oil Black (CI 20150) and Spilon Black, 1:1 or 2:1 type metal complex dyes, and metal (complex) salts of (alkyl) salicylic acid and naphthoic acid.

The particle size of toner particles is preferably such that the volume-based median diameter measured by a Coulter counter is 8 to 14 μm, especially 10 to 12 μm. The particulate shape may be an indeterminate shape formed by melt kneading and pulverization, or a spherical shape formed by dispersion or suspension polymerization.

The weight ratio T/D of the toner in the developer is preferably 0.03 to 0.08, especially 0.035 to 0.075.

In order to attain the object of the present invention, it is preferred that the electric resistance of the developer as a whole be $1\times10^8$ to $1\times10^{11}$ Ω-cm, especially $5\times10^9$ to $5\times10^{10}$ Ω-cm. In the case where the weight ratio T/D of the toner in the developer is increased, in order to effectively prevent scattering of the toner, it is preferred that the delivered quantity (M) be reduced and the drum-sleeve distance (H) be increased.

EXAMPLES

The present invention will now be described in detail with reference to the following examples that by no means limit the scope of the invention.

EXAMPLE 1

Development was carried out by using an improved model of Laser Printer LPX-1 supplied by Mita Kogyo under conditions described below while changing the position and magnetic force of magnets in the sleeve, whereby images were formed.

Figure 4:
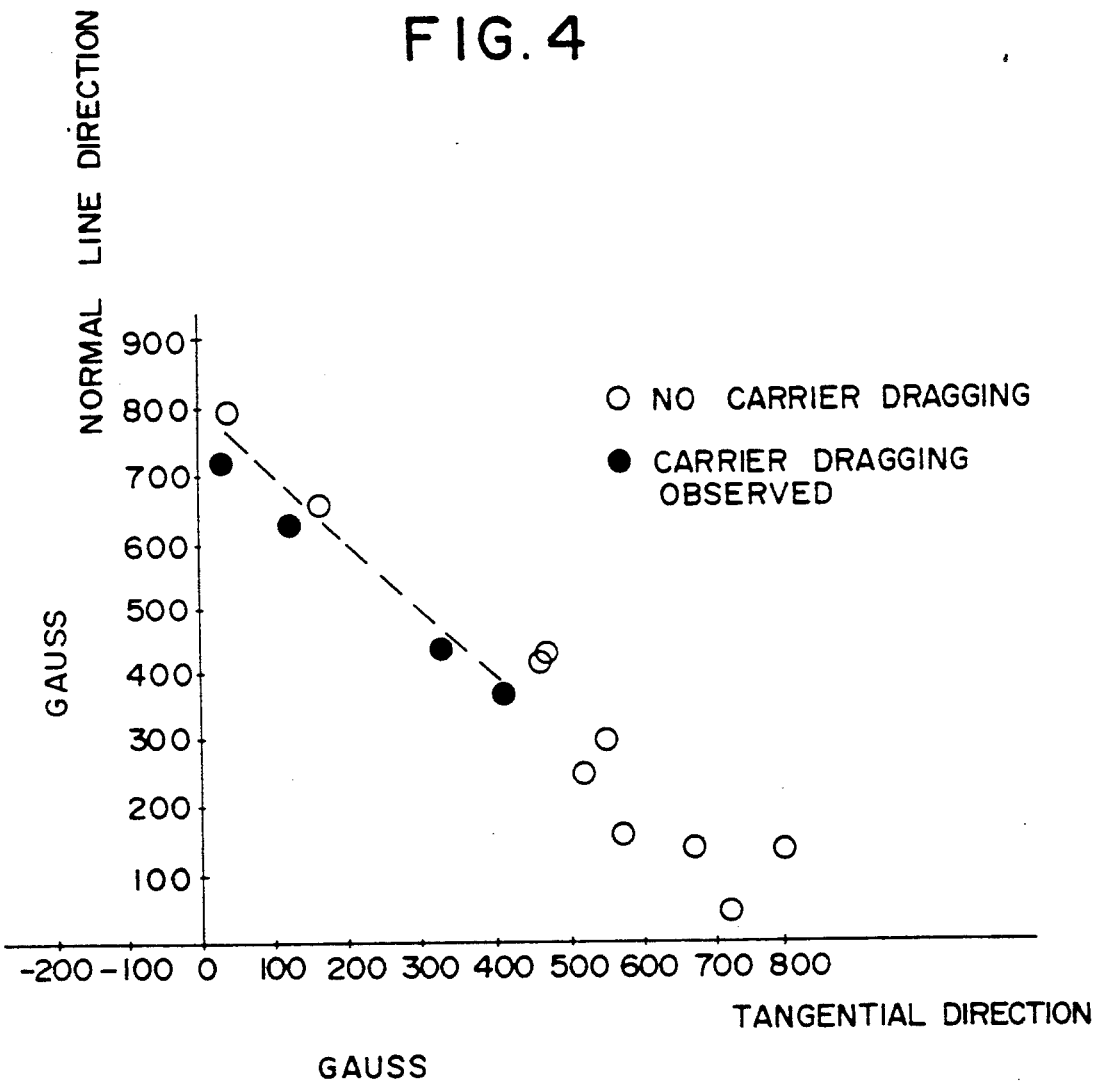
FIG. 4 is a diagram illustrating the relation of the components of the magnetic force in the tangential and normal line directions at the terminal point of the developing zone to the formed image in Example 1.

With respect to each of the obtained images, occurrence of carrier dragging was checked, and the magnetic force components of the tangential direction and normal line direction at the terminal point (position P) of the developing zone were measured. The obtained results are shown in Table 1 and FIG. 4. Developing conditions Sleeve diameter: 20 mm
Peripheral speed of sleeve: 175 mm/sec
Photosensitive material drum:
negatively charged organic photosensitive material
Drum diameter: 60 mm
Peripheral speed of drum: 70 mm/sec
Sleeve diameter/drum diameter ratio 1/3
Sleeve/drum peripheral speed ratio: 2.5
drum/sleeve distance: 0.7 mm
Cut gap of magnetic brush: 0.8 mm
Surface potential of drum: −700 V
Development bias voltage: −400 V
Developer: two-component developer comprising ferrite carrier having average particle size of 90 μm and toner having particle size of 12 μm and having electric resistance of $10^9$ Ω−cm

TABLE 1

| Magnetic Force (gauss) at Terminal Point of Developing Zone | | | |
|---|---|---|---|
| in normal line direction | in tangential direction | composite of magnetic force in normal line and tangential directions | Carrier Dragging (adhesion) |
| 50 | 720 | 300 | not caused |
| 140 | 670 | 360 | not caused |
| 160 | 570 | 310 | not caused |
| 300 | 550 | 490 | not caused |
| 250 | 520 | 380 | not caused |
| 430 | 470 | 520 | not caused |
| 420 | 460 | 550 | not caused |
| 370 | 410 | 480 | caused |
| 440 | 330 | 530 | caused |
| 660 | 160 | 700 | not caused |
| 630 | 120 | 600 | caused |
| 790 | 40 | 800 | caused |
| 790 | 40 | 780 | not caused |

EXAMPLE 2

Images were formed by using an improved model of Laser Printer LPX-1 supplied by Mita Kogyo under conditions described below while changing the amount M of the delivered developer, the weight ratio T/D of the toner, the weight ratio C/D of the carrier and the drum-sleeve distance.

The properties of the obtained images were evaluated, and the developer occupancy ratio R was calculated at each run. The obtained results are shown in Table 2.

Developing conditions
Sleeve diameter: 20 mm
Peripheral speed of sleeve: 210 mm/sec
Photosensitive material drum: negatively charged organic photosensitive material
Surface potential of drum: −700 V
Development bias voltage: −500 V
Magnetic force (Gauss) at terminal (position P) in developing zone:
330 in normal line direction and 440 in tangential direction
Toner: comprising carbon black dispersed in polyester and having volume-based median diameter of 11 μm and true density of 1.11 g/cm$^3$
Carrier: comprising a ferrite core coated with a resin and having saturation magnetization of 55 emu/g, electric resistance of $5\times10^9$ Ω-cm and true density of 5 g/cm$^3$

TABLE 2

| Run No. | Delivered Amount M ($g/cm^2$) | Toner Weight Ratio (wt. %) | Carrier Weight Ratio (wt. %) | Drum/Sleeve Distance (mm) | Developer Occupancy Ratio (%) | Image Properties |
|---|---|---|---|---|---|---|
| 2-1 | 0.111 | 5 | 95 | 0.07 | 37.3 | high-density image |
| 2-2 | 0.094 | 5 | 95 | 0.07 | 31.8 | high-density image |
| 2-3 | 0.110 | 8 | 92 | 0.08 | 35.0 | high-density image |
| 2-4 | 0.101 | 5 | 95 | 0.07 | 40.2 | certain density unevenness |

EXAMPLE 3

In runs of Example 1 where carrier dragging was not caused, images were formed in the same manner by further applying as the development bias voltage an alternating current voltage (frequency: 1 kHz) of −150 to −650 V (Run 3-1), −150 to −800 V (Run 3-2), −50 to −650 V (Run 3—3) or −50 to −750 V (Run 3-4) to the developing sleeve. In each run, scattering of the toner in the vicinity of the formed dot image is reduced, and especially in Run 3-1, the effect was conspicuous and a clear and sharp image was obtained. In Run 3-2, the degree of occurrence of fogging was higher than in the run where only a direct current voltage was applied. In Run 3—3, the degree of adhesion of the carrier was higher than in the run where a direct current voltage alone was applied. In Run 3-4, scattering of the toner was more conspicuous than in the run where a direct current voltage alone was applied.

EXAMPLE 4

Images were formed in the same manner as described in Example 1 by using various magnet rolls.

Results of evaluation of the formed images, and the maximum force position $Y_p$ on the developing sleeve and the magnetic forces in the normal line direction and tangential direction at the terminal point (position P) of the developing sleeve at each run, are shown in Table 3.

Incidentally, the maximum magnetic force position $Y_p$ is represented by the distance (radian) from the position (S) where the drum became closest to the sleeve.

Figure 5:
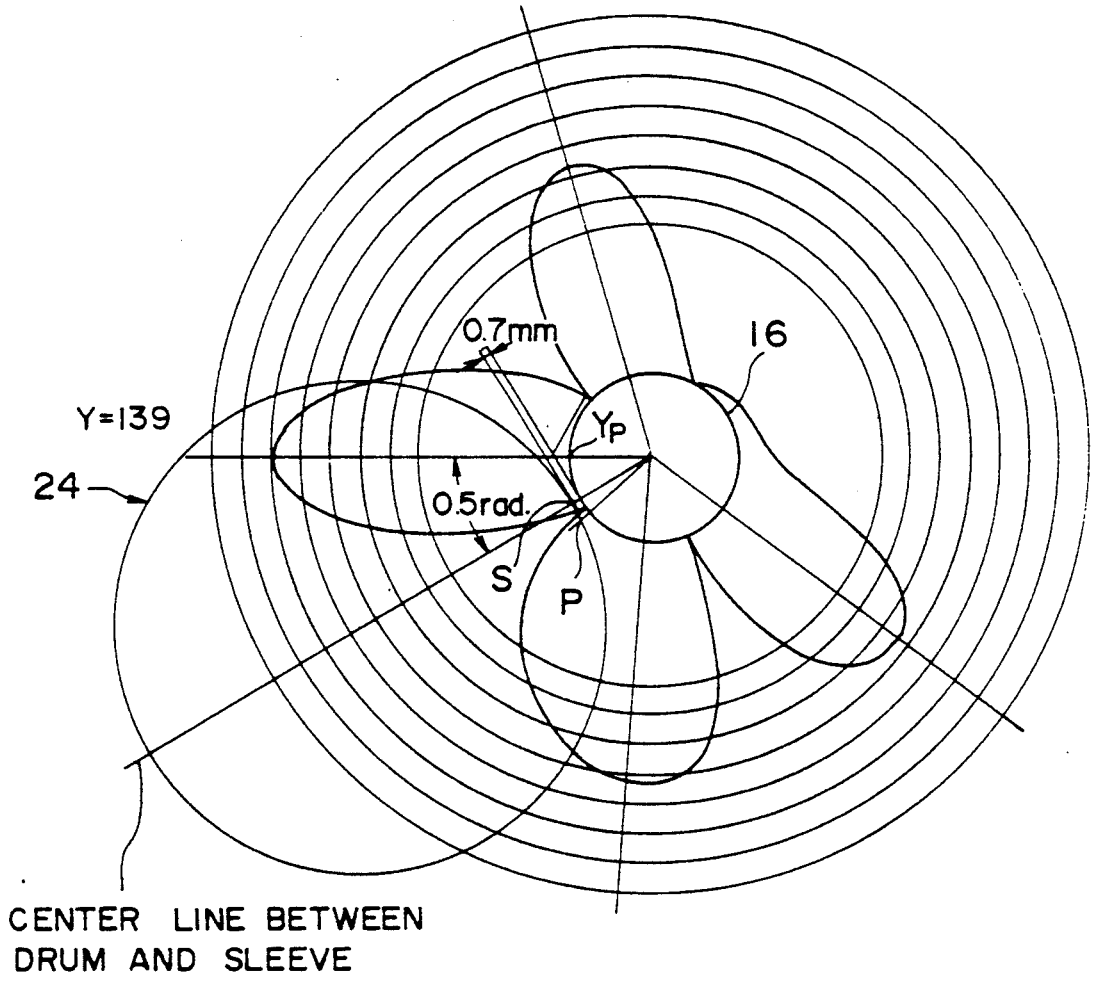
FIG. 5 is a diagram illustrating the distribution of the magnetic force in the normal line direction of the developing sleeve in Run 4–10 of Example 4.

The distribution of the magnetic force in the normal line direction at Run 4-2 is shown in FIG. 3, and the magnetic force distribution at Run 4-10 is shown in FIG. 5.

TABLE 3

| Run No. | Position Yp (radian) of Maximum Magnetic Force in Normal Line Direction | Maximum Magnetic Force (gauss) in Normal Line Direction | Magnetic Force (gauss) in Normal Line Direction at Point P | Magnetic Force (gauss) in Tangential Direction at Point A | Properties of Formed Image |
|---|---|---|---|---|---|
| 4-1 | 0.002 | 1000 | 600 | 200 | no carrier dragging (adhesion), slight sweeping trace, poor line image |
| 4-2 | 0.035 | 900 | 560 | 250 | no carrier dragging (adhesion), no sweeping trace, |
| 4-3 | 0.085 | 850 | 480 | 320 | carrier dragging (adhesion), slight sweeping trance |
| 4-4 | 0.075 | 900 | 480 | 350 | no carrier dragging (adhesion), no sweeping trace, good line image |
| 4-5 | 0.12 | 950 | 420 | 400 | no carrier dragging (adhesion), no sweeping trace, good line image |
| 4-6 | 0.22 | 850 | 320 | 450 | no carrier dragging (adhesion), no sweeping trace, good line image |
| 4-7 | 0.3 | 900 | 260 | 630 | no carrier dragging (adhesion), no sweeping trace, good line image |
| 4-8 | 0.43 | 950 | 190 | 750 | no carrier dragging (adhesion), no sweeping trace, good line image |
| 4-9 | 0.43 | 950 | 190 | 750 | no carrier dragging (adhesion), no sweeping trace, good line image |
| 4-10 | 0.50 | 900 | 139 | 800 | no carrier dragging (adhesion), no sweeping trace, good line image |
| 4-11 | 0.55 | 850 | 110 | 750 | no carrier dragging (adhesion), reduction of image density, image unevenness |

TABLE 4

| Run No. | Delivered Amount M ($g/cm^2$) | Toner Weight Ratio (wt. %) | Carrier Weight Ratio (wt. %) | Drum/ Sleeve Distance (mm) | Developer Occupancy Ratio (%) | Position Yp (radian) of Maximum Magnetic Force | Magnetic Force (gauss) in Normal Direction at Point P | Magnetic Force (gauss) in Tangential Direction at Point P | Properties of Formed Image |
|---|---|---|---|---|---|---|---|---|---|
| 6-1 | 0.094 | 5 | 95 | 0.07 | 31.8 | 0.035 | 420 | 350 | good density, adhesion of carrier |
| 6-2 | 0.115 | 8 | 92 | 0.08 | 36.6 | 0.035 | 560 | 250 | good density, good line reproducibility, no sweeping trace, no carrier adhesion |
| 6-3 | 0.118 | 5 | 95 | 0.07 | 39.9 | 0.08 | 370 | 420 | good density, good line reproducibility, carrier adhesion |
| 6-4 | 0.120 | 8 | 92 | 0.05 | 61.1 | 0.15 | 350 | 500 | good density, good line reproducibility, no sweeping trace, no carrier adhesion |
| 6-5 | 0.120 | 10 | 90 | 0.05 | 64.4 | 0.15 | 350 | 500 | good density, good line reproducibility, no sweeping trace, no carrier adhesion |
| 6-6 | 0.130 | 10 | 90 | 0.05 | 69.7 | 0.25 | 230 | 630 | good density, good line reproducibility, no sweeping trace, no carrier adhesion |
| 6-7 | 0.222 | 8 | 92 | 0.08 | 70.6 | 0.5 | 139 | 800 | good density, good line reproducibility, no sweeping trace, no carrier adhesion |
| 6-8 | 0.222 | 8 | 82 | 0.07 | 80.7 | 0.25 | 230 | 630 | scattering of toner, image fogging, reduction of density |
| 6-9 | 0.130 | 10 | 90 | 0.05 | 69.7 | 0.53 | 110 | 820 | reduction of image density, carrier adhesion, sweeping trace |

EXAMPLE 5

Images were formed under the same conditions as adopted at Runs 4–5 and 4–6 of Example 4 by using a carrier having a saturation magnetization of 45 emu/g and an average particle size of 65 μm and being liable to cause carrier dragging. However, carrier dragging was not observed but an image having a good soft image was obtained.

EXAMPLE 6

Images were formed in the same manner as described in Example 4 while changing the developer occupancy ratio R and the positions of magnet poles of the magnet roll.

The properties of the formed images and the magnetic force distributions in the developing zone are shown in Table 4.

We claim:

1. A process for developing an electrostatic latent image on the surface of a photosensitive material drum, which comprises forming a magnetic brush of a two-component magnetic developer comprising a toner and a carrier on a developing sleeve having magnets disposed in the interior thereof, and bringing the magnetic brush of the developer into sliding contact with the surface of the photosensitive material drum in a development zone in an amount such that the developer occupancy ratio R in the developing zone, represented by the following formula, satisfies the requirement of $30<R<75$:

$$R=M\times(T/D\times 1/\sigma t+C/D\times 1/\sigma c)/H$$

wherein M represents the amount ($g/cm^2$) of the developer delivered per unit area of the developing sleeve, H represents the distance (cm) between the photosensitive material drum and the developing sleeve at the position (S) where both approach each other most closely, T/D represents the toner concentration (% by weight) in the developer, C/D represents the carrier concentration (% by weight) in the developer, $\sigma t$ represents the true density ($g/cm^3$) of the toner, and $\sigma c$ represents the true density ($g/cm^3$) of the carrier, to develop the surface of the photosensitive material drum, wherein the development is carried out under such conditions that (1) at the position where the sliding contact of the magnetic brush with the surface of the photosensitive material drum terminates, the following requirement is satisfied:

$$Px\geqq 430, \text{ or}$$

$$Px<430 \text{ and } P_y\geqq -Px+800,$$

wherein $P_x$ represents the magnetic force (Gauss) acting in the tangential direction on the surface of the developing sleeve, and Py represents the magnetic force (Gauss) acting in the normal line direction on the surface of the developing sleeve; and (2) the magnetic force in the normal line direction on the surface of the developing sleeve in the developing zone becomes maximum at the position located on the upstream side by 0.035 to 0.5 radian in the direction of the flow of the developer from the position(s) where the developing sleeve comes closest to the photosensitive material drum.

2. A developing process according to claim 1 wherein the development is carried out while applying to the developing sleeve an alternating current voltage capable of an alternating electric field between the maximum potential and minimum potential of the electrostatic latent image formed on the surface of the photosensitive material drum.

3. A developing process according to claim 2 wherein the alternating voltage is in the range of from 300 to 700 V and has a frequency of from 0.5 to 3 kHz.

4. A developing process according to claim 1 wherein the magnetic force in the normal line direction on the surface of the developing sleeve in the developing zone is a maximum at the position located on the upstream side by 0.14 to 0.42 radian, in the direction of the flow of the developer from the position(s) where the developing sleeve and the photosensitive material drum come closest to each other.

5. A developing process according to claim 1 which comprises rotating the developing sleeve at a peripheral speed of from 60 to 800 mm/sec and forming the magnetic brush with a cut length of from 0.6 to 1.6 mm.

6. A developing process according to claim 1 which comprises rotating the developing sleeve at a peripheral speed of from 90 to 450 mm/sec and forming the magnetic brush with a cut length of from 0.8 to 1.4 mm.

7. A developing process according to claim 6 wherein the distance H is 0.4 to 1.6 mm and the diameter of the developing sleeve is from 15 to 50 mm.

8. A developing process according to claim 7 wherein the occupancy ratio R is less than 40.

* * * * *